US005740854A

United States Patent [19]

Inoue et al.

[11] Patent Number: 5,740,854

[45] Date of Patent: Apr. 21, 1998

[54] PRODUCTION METHODS OF METALLIC GLASSES BY A SUCTION CASTING METHOD

[75] Inventors: Akihisa Inoue, Kawauchijutaku 11-806, Kawauchi mubanchi, Aoba-ku Sendai-shi, Miyagi; Tao Zhang; Eiichi Makabe, both of Sendai, all of Japan

[73] Assignees: Akihisa Inoue; Kabushiki Kaisha Makabe Giken, both of Miyagi, Japan

[21] Appl. No.: 892,181

[22] Filed: Jul. 14, 1997

Related U.S. Application Data

[63] Continuation of Ser. No. 542,615, Oct. 13, 1995, abandoned.

[30] Foreign Application Priority Data

Oct. 14, 1994 [JP] Japan ..... 6-249254

[51] Int. Cl.[6] ..... B22D 27/04; B22D 27/15

[52] U.S. Cl. ..... 164/495; 164/63; 164/122; 164/136

[58] Field of Search ..... 164/495, 494, 164/493, 122, 61, 62, 63, 65, 133, 136

[56] References Cited

U.S. PATENT DOCUMENTS 5,485,876 1/1996 Horimura ..... 164/122

*Primary Examiner*—Kuang Y. Lin

*Attorney, Agent, or Firm*—Young & Thompson

[57] ABSTRACT

This invention provides a glassy metal-suction casting method capable of readily and conveniently producing a large-sized amorphous material with excellent properties as an amorphous material. Such an object of the invention is attained by filling a metal material in a mold cooled with water; melting said metal material by using a high-energy heat source which is capable of rapidly melting said metal material; and introducing the resulting molten metal instantaneously into a vertically extending water-cooled mold provided below said mold by using a difference in gas pressure or gravity to move the metal melt at a high speed and attain a high quenching rate to thereby enable the production of a glassy metal ingot of a large size.

2 Claims, 6 Drawing Sheets

PRODUCTION METHODS OF METALLIC GLASSES BY A SUCTION CASTING METHOD

This application is a continuation of application Ser. No. 08/542,615, filed Oct. 13, 1995, now abandoned.

BACKGROUND OF THE INVENTION

This invention relates to production methods of Metallic Glasses by a suction casting method for producing a large-sized glassy metal ingot of various configuration wherein speed of the melt moving into the mold by using the suction casting method, which is the main element for quenching the metal material, is increased to attain a high cooling rate.

Various methods for producing amorphous material have been proposed. Exemplary such methods are the method wherein a molten metal or alloy in liquid state is solidified by quenching and the resulting quenched metal (alloy) powder is compacted at a temperature below the crystallization temperature to produce a solid of the predetermined configuration having the true density; and the method wherein a molten metal or alloy is solidified by quenching to directly produce an ingot of the amorphous material having the predetermined configuration. Almost all amorphous material produced by such conventional methods had an insufficiently small mass, and it has been impossible to produce a bulk material by such conventional methods. Another attempt for producing a bulk material is solidification of the quenched powder. Such attempt, however, has also failed to produce a satisfactory bulk material.

For example, the amorphous materials produced in small mass have been produced by melt spinning, single roll method, planar flow casting and the like whereby the amorphous material in the form of thin strip (ribbon) in the size of, for example, about 200 mm in the strip width and about 30 μm in the strip thickness were produced. Use of such amorphous materials for such purposes as the core material of a transformer has been attempted, but so far, most amorphous materials produced by such methods are not yet put to industrial use. The techniques that have been used for compaction molding the quenched powder into an amorphous material of a small mass include CIP, HIP, hot press, hot extrusion, electro-discharge plasma sintering, and the like. Such techniques, however, suffered from the problems of poor flow properties due to the minute configuration, and the problem of temperature-dependent properties, namely, incapability of increasing the temperature in excess of glass transition temperature. In addition, compaction molding involves many steps, and the compaction molded materials produced suffer from insufficient properties as a bulk material. Therefore, such methods are still insufficient.

Recently, the inventors of the present invention found that a number of ternary amorphous alloys such as Ln-Al-TM, Mg-Ln-TM, Zr-Al-TM, Hf-Al-TM and Ti-Zr-TM (wherein Ln is a lanthanide metal, and TM is a transition metal of the Groups VI to VIII) ternary systems have low critical cooling rates for glass formation of the order of $10^2$ K/s, and can be produced in a bulk shape with thickness up to about 9 mm by using a metallic mold casting or a high-pressure die casting method.

It has been, however, impossible to produce a large-sized amorphous alloy ingot of desired configuration irrespective of the production method. There is a strong needs for the development of a new solidification technique capable of producing a large-sized amorphous alloy ingot and an amorphous alloy having a still lower critical cooling rate for enabling the production of the amorphous metal material of larger size.

SUMMARY OF THE INVENTION

An object of the present invention is to provide production methods of metallic glasses by a suction casting method capable of readily and conveniently producing a large-sized amorphous metal material with excellent properties as an amorphous material.

The inventors of the present invention proceeded with the investigation of the bulk amorphous alloy using the ternary alloy by focusing on the effect of increasing the number of the alloy constituents each having different specific atom size as exemplified by the high glass formation ability of the ternary alloy primarily attributable to the optimal specific size distribution of the constituent atoms that are mutually different in size by more than 10%. As a consequence, the inventors found amorphous alloys of Zr-Al-Co-Ni-Cu alloy systems and Zr-Ti-Hf-Al-Co-Ni-Cu alloy systems that have significantly lower critical cooling rates in the range of from 1 to 100 K/s, and that alloys of Zr-Al-Ni-Cu alloy systems may be produced into a bulk amorphous alloy ingot with a size of up to 16 mm in diameter and 150 mm in length by quenching the melt in a quartz tube into water.

The inventors of the present invention also found that the resulting bulk amorphous alloy ingot has a tensile strength of as high as 1500 MPa comparable to the compressive strength and break (crack) accompanying serrated plastic flow in the tensile stress-strain curves, and that such high tensile strength and serrated plastic flow phenomenon result in excellent malleability despite the large thickness of the bulk amorphous alloy produced by casting.

On the bases of the above-described findings of the bulk amorphous alloy production, the inventors of the present invention have continued an intensive study to thereby develop a method that is capable of producing a glassy metal ingot of even larger size with various configurations by a simple procedure. As a consequence, the inventors found that such an object may be achieved by instantaneously casting the molten metal material in a mold cooled with water. The present invention was thereby attained.

More illustratively, there is provided by the present invention a method for producing a glassy metal by suction casting characterized in that said method comprises the steps of filling a metal material (such as active metal) in a mold cooled with water; melting said metal material by using a high-energy heat source which is capable of melting said metal material; and introducing the resulting molten metal instantaneously into a vertically extending water-cooled mold provided below said mold by using a difference in gas pressure or gravity to move the metal melt at a high speed and attain a high quenching rate to thereby enable the production of a glassy metal ingot of a large size.

The molten metal is preferably moved together with the vertically extending water-cooled mold at a speed of 50 mm/sec or higher, and the speed of the melt is increased by the resulting negative pressure to increase the quenching rate of the melt.

The configuration of the glassy metal formed by the vertically extending water-cooled mold may preferably be a cylindrical rod, a plate, a pipe, a rectangular rod, a rectangular pipe, a profile rod, or a profile pipe.

BRIEF DESCRIPTION OF THE DRAWINGS

FIG. 2(*a*) is a schematic drawing of the step of melting the metal material, and FIG. 2 (*b*) is a schematic drawing of the step of casting the molten metal.

DETAILED DESCRIPTION OF THE INVENTION

Figure 1:
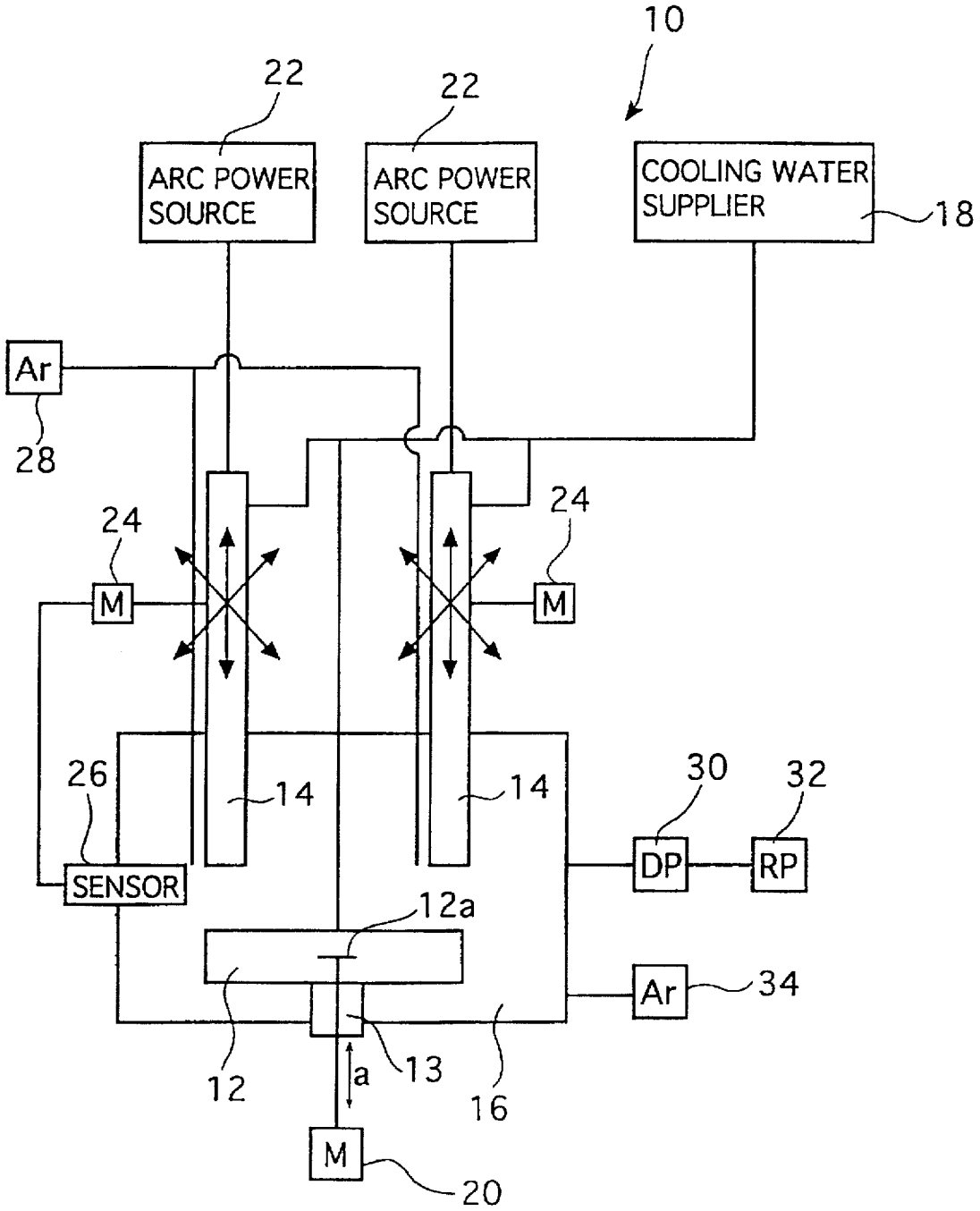
FIG. 1 This figure is a flow sheet showing the mechanism of an embodiment of the suction casting glassy metal production apparatus used in carrying out the suction casting glassy metal production process according to the present invention.

In the production method of metallic glass by the suction casting method, that is the suction casting glassy metal production process of the present invention, a metal material which may preferably be a metal powder or pellet mixture having a high amorphous phase forming ability is filled in a water-cooled mold such as a water-cooled copper hearth in the form of a recess provided with a vertically movable bottom portion. After reducing the pressure of the chamber and purging the chamber with an inert gas, the metal material is melt with a high energy heat source such as an arc heat source with the hearth portion of the mold forcefully cooled. The bottom portion is subsequently moved downward, and the molten metal is cast into the water-cooled mold by gravity or by increasing the pressure of the chamber. The quenching of the molten metal results in the generation of the large-sized bulk glassy metal ingot.

In this step, the molten metal and the bottom portion of the mold are preferably moved at a speed of as high as 50 mm/sec or higher to generate negative pressure in addition to gravity to thereby increase the speed of the casting. At the same time, the pressure of the atmosphere on the side of the melt is maintained at a pressure higher than the atmospheric pressure during the casting. As a consequence, the quenching rate is increased, and the production of a bulk ingot of a larger size, and a stable production of a large-sized amorphous alloy (glassy metal) from the molten metal are enabled.

The method of the present invention may be applied for the alloys of almost any combination of the elements including the above mentioned ternary alloys, Zr-Al-Ni-Cu and Zr-Al-Ni-Cu-Pd alloys and other multi-component alloys comprising four or more components to form the amorphous phase. When such alloys are used for the metal material of the invention, it would be preferable to use the alloy in powder or pellet form to facilitate rapid melting of the alloy by high energy heat source. The form of the alloy, however, is not limited to such forms, and the metal material used may be in any form so long as rapid melting is possible. Exemplary forms other than powder and pellets include wire, ribbon, rod, and ingot, and a metal material of any desired form may be adequately selected depending on the water-cooled hearth and the high-energy heat source employed.

The high-energy heat source is not limited to any particular type, and any heat source may be employed so long as it is capable of melting the metal material filled in the water-cooled mold. Typical high-energy heat sources include arc heat source, plasma heat source, electron beam, and laser. When such heat source is employed, either single heat source or multiple heat sources may be provided per one water-cooled mold.

The movement of the molten metal together with the vertical water-cooled mold may be conducted at any speed exceeding the predetermined speed, which is preferably 50 mm/sec or higher, and the movement may be promoted by any manner so long as the speed of the molten metal (melt) can be increased to accelerate the quenching rate.

It should be noted that the term, high speed used herein for the movement of the molten metal designates the highest possible speed that would not involve the movement of the atmospheric gas. Such care is taken for the purpose of preventing the contamination of the solidifying melt that may take place when the melt is moved at an excessively high speed, as exemplified by the case utilizing an arc heat source wherein atmospheric gas for arc generation may be incorporated into the solidifying melt.

Embodiments

The method for producing a glassy metal by suction casting of the present invention is described in detail by referring the preferred embodiment shown in the attached drawings.

FIG. 1 is a flow sheet schematically showing the constitution of an apparatus for producing a glassy metal by suction casting according to the present invention.

As shown in FIG. 1, the apparatus 10 for producing a glassy metal by suction casting according to the present invention comprises a water-cooled copper mold (hearth) 12 for receiving a metal material, for example, a powder or pellet metal material, which is in the form of a recess of a predetermined configuration provided with a mechanism for elevating its bottom portion; a vertically extending lower water-cooled copper mold 13 provided below the water-cooled hearth 12; water-cooled electrodes (tungsten electrodes) 14, 14 for arc melting the metal material in the water-cooled copper hearth 12; a vacuum chamber 16 for accommodating the water-cooled hearth 12 and the water-cooled electrodes 14, 14; and a cooling water supplier 18 for supplying a cooling water to the water-cooled hearth 12 and the water-cooled electrodes 14, 14 by water circulation.

As mentioned above, the water-cooled hearth 12 is provided with a bottom portion 12*a*, and the movement of the bottom portion 12*a* is controlled by a DC servo motor 20 so that the molten metal may be cast into the water-cooled lower copper mold 13 by the difference in gas pressure. The water-cooled electrodes 14 are connected to an arc power source 22. The water-cooled electrodes 14 are arranged at a slight angle from the direction of the movement of the bottom portion 12*a* of the water-cooled hearth 12, and arrangement of the electrodes 14 may be controlled in X, Y and Z directions by a stepping motor 24. In order to keep the gap (in Z direction) between the metal material in the water-cooled hearth 12 and the water-cooled electrodes 14 constant, the position of the metal material may be detected by a semiconductor laser sensor 26 to automatically control the movement of the water-cooled electrodes 14 by the motor 24. When the gap between the arc electrodes 14 and the metal material is inconsistent, the arc established would be unstable, leading to inconsistency in the melt temperature. A nozzle for discharging a cooling gas (for example, argon gas) may be provided near the arc generation site of the water-cooled electrode 14 to discharge the cooling gas supplied from the a gas source (a steel gas cylinder) 28 to thereby promote rapid quenching of the molten metal after the heat melting.

The vacuum chamber 16 has the structure of water-cooling jacket made from an SUS stainless steel, and is connected to an oil diffusion vacuum pump (diffusion pump) 30 and oil rotary vacuum pump (rotary pump) 32. The vacuum chamber 16 has an argon gas inlet port in communication with a gas source (a steel gas cylinder) 34 to enable purging of the atmosphere with the inert gas after drawing a vacuum. The cooling water supplier 18 cools the cooling water that has circulated back by means of a coolant, and then send the thus cooled cooling water to the water-cooled hearth 12 and the water-cooled electrodes 14.

Figure 2B:
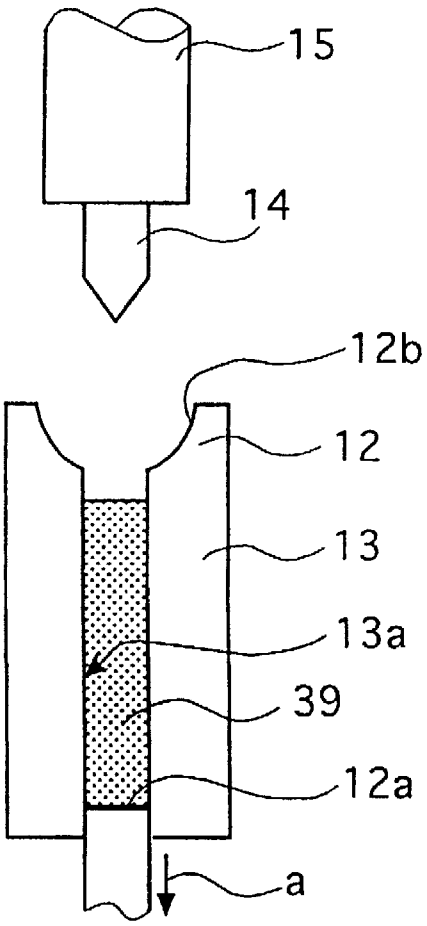
FIGS. 2(*a*) and 2(*b*). These figures schematically show an exemplary process of producing a large-sized bulk amorphous alloy ingot by the suction casting glassy metal production apparatus utilizing an arc electrode for the heat source.
Figure 2A:
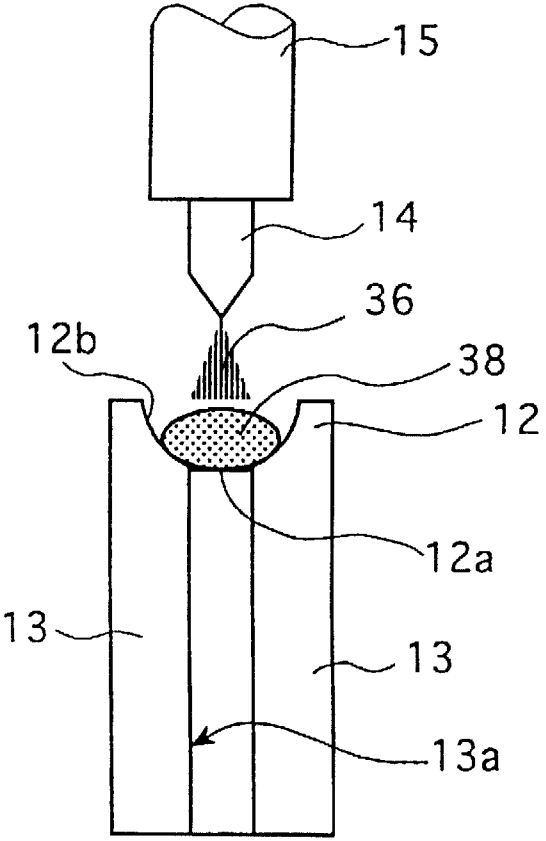

Next, the method for producing a glassy metal by suction casting according to the present invention is described by referring to FIGS. 1 and 2.

FIG. 2(*a*) is a schematic cross-sectional view showing the step of arc melting of the metal material in the process for producing a bulk amorphous alloy of a large size in the suction casting glassy metal production apparatus; and FIG. 2(*b*) is a schematic cross-sectional view of the step of casting the bulk amorphous alloy in the vertically extending water-cooled copper mold.

As shown in FIG. 2(*a*), the movable bottom portion 12*a* of the water-cooled hearth 12 is first positioned at its initial position by a motor 20, and then, the metal material (powder, pellet, crystal) is filled in the recess (concave mold face) 12*b* of the water-cooled copper hearth 12. In the meanwhile, the water-cooled electrodes 14, 14 are controlled for their position in X, Y, and Z directions, and positioned to the position where the gap (in Z direction) is at a predetermined value by means of a sensor 26 and a motor 24 via their adapters 15.

Next, the diffusion pump 30 and the rotary pump 32 are turned on to evacuate the chamber 16 to a high vacuum of $5\times10^{-4}$ Pa (by using liquid nitrogen trap), and argon gas is supplied from the argon gas source 34 to the chamber 16 to purge the chamber with the argon gas, and preferably, to a pressure higher than atmospheric pressure. The water-cooled copper hearth 12, the water-cooled lower copper mold 13, and the water-cooled electrodes 14 are cooled by the cooling water from the cooling water supplier 18.

After completing the above-described preliminary procedure, the arc power source 22 is turned on to generate plasma arc 36 between the tip of the water-cooled electrode 14 and the metal material to thereby completely melt the metal material into a molten alloy 38. Next, the arc power source 22 is turned off to extinguish the plasma arc 36, and the DC servo motor 20 is turned on to move or draw the movable bottom portion 12*a* of the water-cooled copper hearth 12 in downward direction (shown by arrow a) as shown in FIG. 2(*b*) at a predetermined speed, which is preferably 50 mm/sec or higher, until the movable bottom portion 12*a* reaches the predetermined position. As the movable bottom portion 12*a* is moved downward, a negative pressure is created within the water-cooled lower copper mold 13, and the molten alloy 38 receiving a pressure higher than atmospheric pressure from the ambient atmosphere is instantaneously drawn into the water-cooled lower copper mold 13 below the water-cooled copper hearth 12 by means of the difference in gas pressure at a speed equal to the speed of the movable bottom portion 12*a* to be cast therein. The (metal melt) molten metal 38 is thus moved at a high speed, and hence, quenched at a high speed. Consequently, the molten metal 38 is rapidly solidified within the water-cooled lower copper mold 13 and a large-sized amorphous alloy 39 having a cross sectional configuration corresponding to the mold 13 is thereby produced.

After complete melting of the metal material in the water-cooled hearth 12, the cooling argon gas from the steel gas cylinder 28 may be discharged from the nozzles (not shown) provided near the arc generating site of the water-cooled electrode 14 to cool the molten metal 8 and facilitate the rapid quenching of the molten metal 38 after the heat melting. The molding surface 13*a* of the water-cooled lower copper mold 13 may have non-limited configuration, for example, cylindrical, annular cylindrical, rectangular, annular rectangular, polygonal, annular polygonal, or the like, and consequently, the resulting large-sized amorphous bulk alloy (glassy metal) ingot 39 may have a cylindrical rod, a plate, a pipe, a rectangular rod, a rectangular pipe, a profile rod, or a profile pipe or any other configuration.

EXAMPLES

Next, the method for producing a glassy metal by suction casting according to the present invention is described in greater detail by referring to the Examples.

Figure 3:
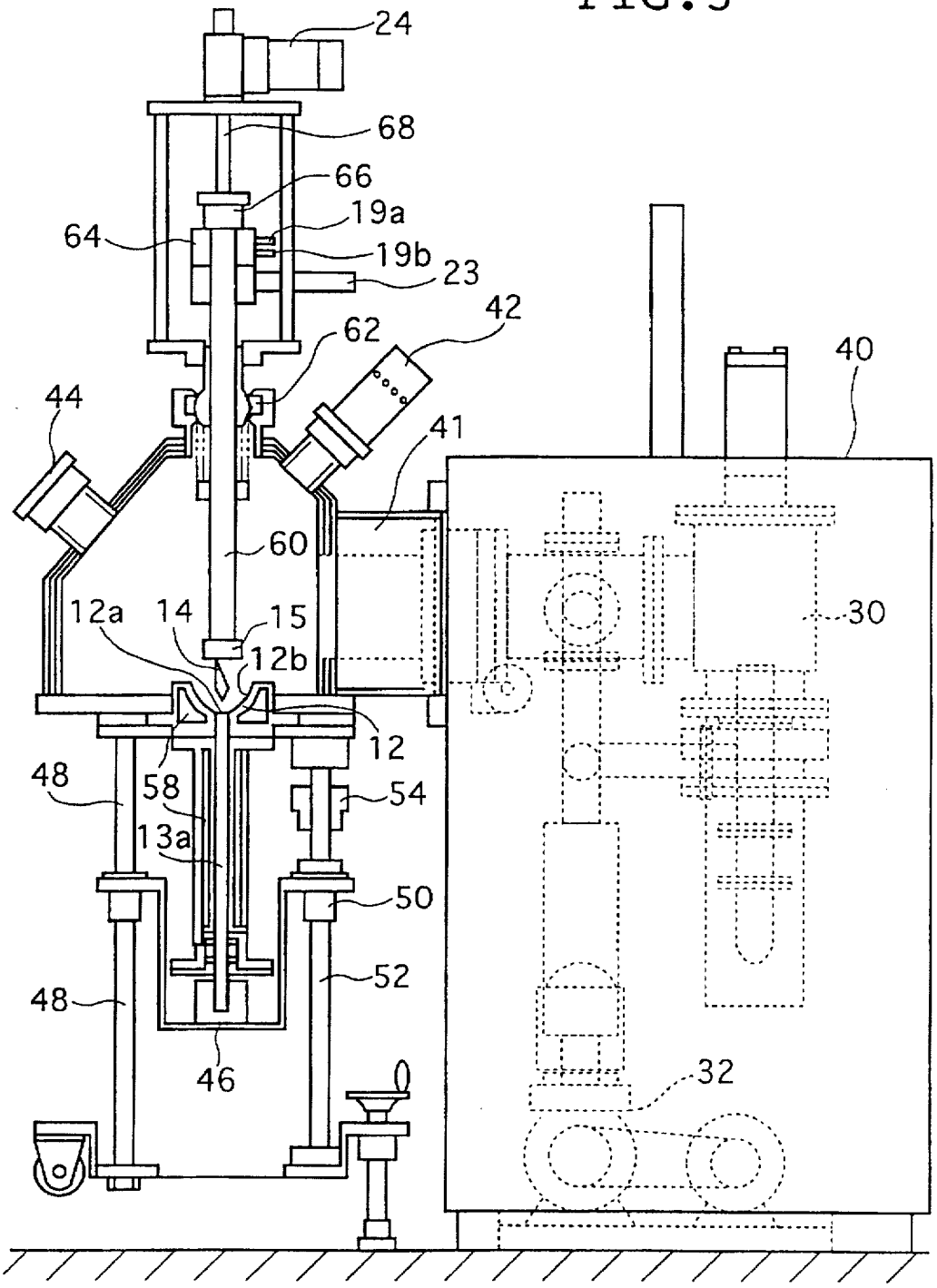
FIG. 3 This figure is a partial elevational cross-sectional view of an embodiment of the suction casting glassy metal production apparatus used in carrying out the suction casting glassy metal production process according to the present invention used in the Example of the present invention.
Figure 4:
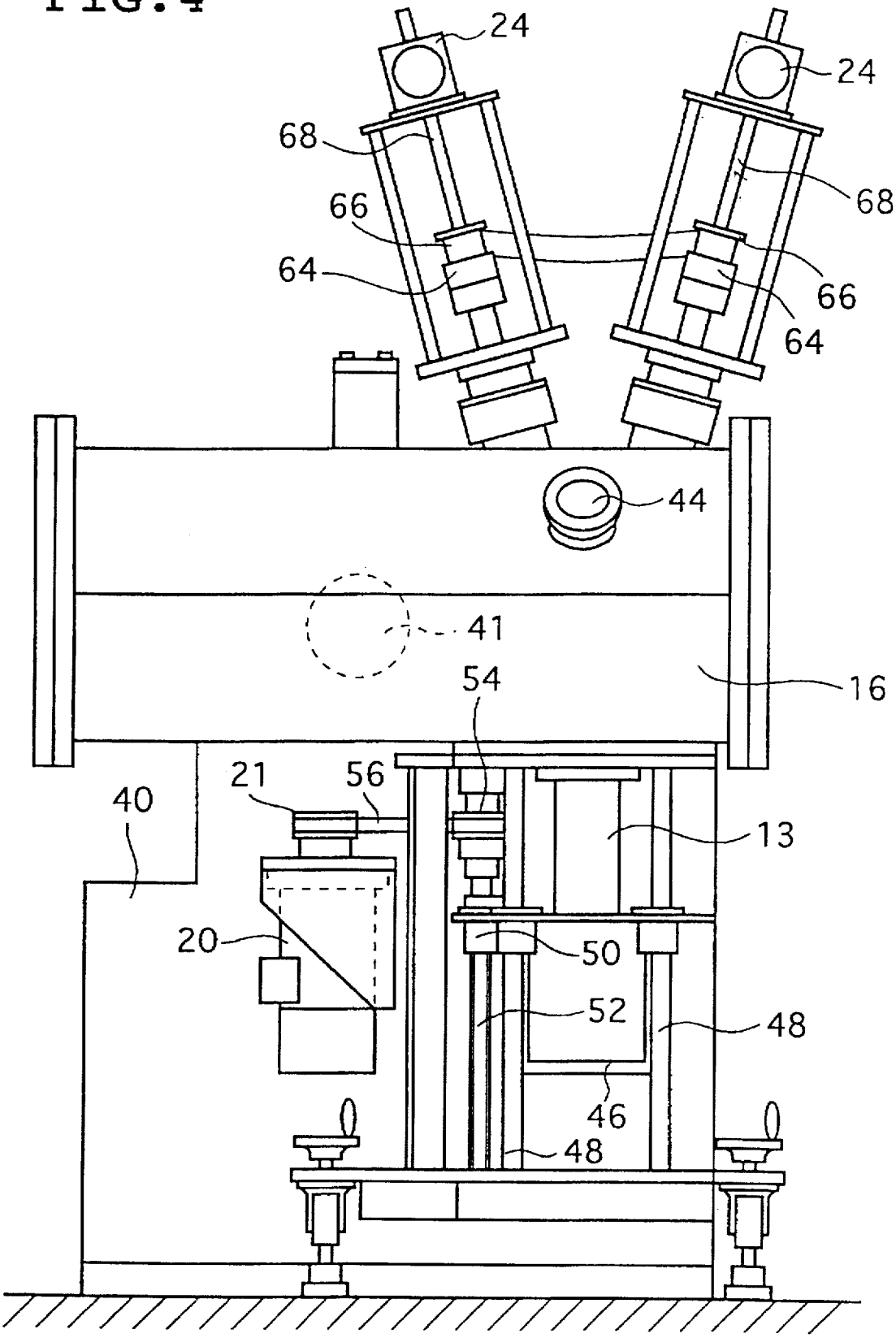
FIG. 4 This figure is a side view of the suction casting glassy metal production apparatus of FIG. 3.

Large-sized amorphous $Zr_{65}Al_{7.5}Ni_{10}Cu_{17.5}$ bulk alloy ingots with a diameter of 10 mm and a length of 500 mm; a diameter of 16 mm and a length of 200 mm; and a diameter of 30 mm and a length of 100 mm were produced by using the suction casting glassy metal production apparatus having the structure schematically shown in FIGS. 3 and 4. The $Zr_{65}Al_{7.5}Ni_{10}Cu_{17.5}$ alloy has been selected for the production of the large-sized amorphous bulk alloy ingot in view of its high resistance to heterogeneous nucleation of the crystalline phase as well as its high glass-forming ability as a multi-component alloy.

Referring to FIGS. 3 and 4, there is illustratively shown the suction casting glassy metal production apparatus 10 of FIG. 1 in its cross sectional and lateral views, respectively. The suction casting glassy metal production apparatus 10 shown in FIGS. 3 and 4 has a hearth furnace comprising the water-cooled copper hearth 12 having a spherical recess 12*b* and a vertically movable bottom portion 12*a*, the water-cooled electrodes 14 (one of which is shown) whose movement may be controlled in X, Y and Z directions, and the vacuum chamber 16 for accommodating the hearth furnace; the water-cooled lower copper mold 13 having a circular cross section provided below the water-cooled copper hearth 12; and the cooling water supplier 18 which is not shown (18, see FIG. 1) for supplying the cooling water to the water-cooled hearth 12 and the water-cooled electrodes 14 by water circulation. The vacuum chamber 16 is connected to an evacuator 40 by an intervening connector 41, and in the evacuator 40 are provided the diffusion pump 30, the rotary pump 32 (see FIG. 1) and the like. The vacuum chamber 16 is also provided with a light 42 and a sight glass 44, and for the purpose of avoiding the emission of the high radiation heat, the sight glass 44 is provided with a protection filter and a water cooling jacket.

The water-cooled copper hearth 12 is provided with the mold face 12*b* of a circular cross section, and the vertically movable bottom portion 12*a* of a circular cross section is defined in the central bottom surface of the mold phase 12*b*. In the water-cooled lower copper mold 13 provided below the water-cooled copper hearth 12, a cavity (recess) 13*a* into which the molten metal is to be cast is formed as the movable bottom portion 12*a* of the water-cooled copper hearth 12 moves downward from its initial position. The movable bottom portion 12*a* is in the form of a rod with a circular cross section, and its bottom end is fastened to the central portion of a U-shaped support 46. One end of the U-shaped support 46 is movably secured to two linear guides 48, 48, whose upper end is fastened to the bottom face of the vacuum chamber 16. The other end of the U-shaped support 46 is fastened to a nut 50 movably engaged on a driving ball screw 52, whose upper end is rotatably secured to the bottom face of the vacuum chamber 16. On the driving ball screw 52 is secured a pulley 54, and an endless belt 56 is looped over the pulley 54 and a pulley 21 secured to the rotating shaft of the DC servo motor 20. The speed of the movable bottom portion 12*a* of the water-cooled hearth 12 is accurately controlled to the range of from 0.1 to 1 m/sec by such driving mechanism. A high pitch boring thread is employed for the driving ball screw 52 to enable a rapid movement of the nut 50.

The water-cooled hearth 12 and the water-cooled lower copper mold 13 are respectively provided with the cooling water channels 58, 58 in the manner which enables optimal heat exchange. The cooling water channel 58 is supplied with the cooling water from the cooling water supplier which is not shown (18, see FIG. 1). Although not shown, the movable bottom portion 12*a* is also cooled from its interior by the cooling water supplied from the cooling water supplier (18, see FIG. 1). It should be noted that in this Example, the mold unit comprising the water-cooled hearth 12 and the water-cooled lower copper mold 13 is exchangeable, and available mold sizes include 10 mm diam.×500 mm; 16 mm diam.×200 mm; 20 mm diam.×200; and 30 mm diam.×500 mm.

The water-cooled electrode 14 is accommodated in a sheath 60, and the tip of the water-cooled electrode 14 is secured to the adapter 15. The water-cooled electrode 14 is also movably secured to the top face of the vacuum chamber 16 by an intervening seal 62. The water-cooled electrode 14 and the sheath 60 are fastened to a head 64 which is fastened to a movable nut 66. The movable nut 66 is threaded on a driving screw 68 driven by the stepping motor 24, and the nut 66 and the driving screw 68 constitute the driving unit that drives the water-cooled electrode 14 and the sheath 60. The position along Z axis (in vertical axis) of the water-cooled electrode 14, namely, the gap between the water-cooled electrode 14 and the metal material (36) on the water-cooled hearth 12 is automatically controlled to a predetermined value. Movement of the water-cooled electrode 14 in X and Y directions is also controlled by the stepping motor although not shown. The head 64 is provided with a terminal 23 for connection with the 1000 A DC arc power source which is not shown (22, see FIG. 1) by an intervening cable. As a consequence, the arc electrode 14 can fully utilize the arc heat source of 3,000° C., and the temperature can be controlled with IC cylister. The head 64 is provided with an inlet port 19*a* and an outlet port 19*b* for the cooling water supplied from the cooling water supplier (18) which is not shown to enable the cooling of the electrode 14 accommodated in the sheath 60 and the adapter 15. The head 64 is also provided with a cooling argon gas inlet to thereby enable introduction of the argon gas from the steel gas cylinder (28) which is not shown, and the thus introduced argon gas is injected from a cooling gas injection port (not shown) provided on the adapter 15. The arc generating site of the electrode 14 comprises thorium-containing tungsten, and therefore, electrode consumption and contamination is minimized. At the same time, the water-cooled structure of the electrode 14 mechanically and thermally contributes for the stabilization of the arc generation to enable continuous operation at a high thermal efficiency.

In this Example, the suction casting glassy metal production apparatus 10 having the structure as described above was operated under the conditions as described below. The electric current and the voltage employed for the arc melting were 250 A and 20 V, respectively. The gap between the water-cooled electrode 14 and the metal material in the form of a powder or pellets was adjusted to 0.7 mm.

The large-sized bulk amorphous alloy ingot produced by the procedure as described above was evaluated for its structure by X-ray diffractometry, optical microscopy, energy diffusion X-ray spectroscopy combined with scanning electron microscopy. The sample for the optical microscopy was subjected to an etching treatment in 30% hydrofluoric acid solution at 303 K for 1.8 ks. The sample was also evaluated for its structural relaxation, glass transition temperature (Tg), crystallization temperature (Tx), and heat of crystallization (ΔHx) by differential scanning calorimetry (DSC) at a heating rate of 0.67 K/s. The sample was also evaluated for its hardness by Vickers microhardness tester at a load of 100 g.

Figure 5:
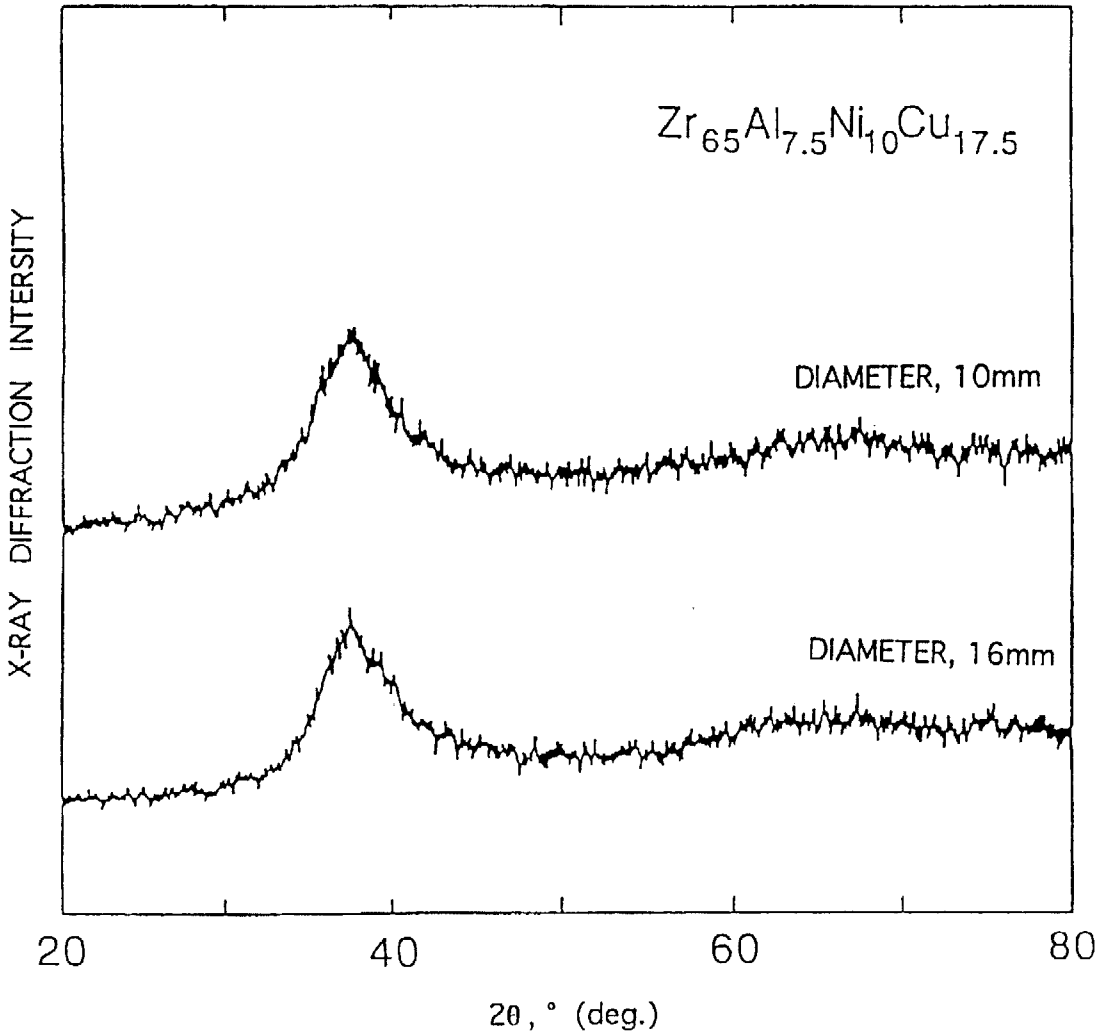
FIG. 5 This figure shows X-ray diffraction patterns for the large-sized cylindrical columnar bulky $Zr_{65}Al_{7.5}Ni_{10}Cu_{17.5}$ alloy ingots each having a diameter of 10 mm and 16 mm produced in the Example of the present invention. The X-ray diffraction patterns shown represent those for the specimens taken from longitudinally and transversely central region of the ingots.
Figure 6:
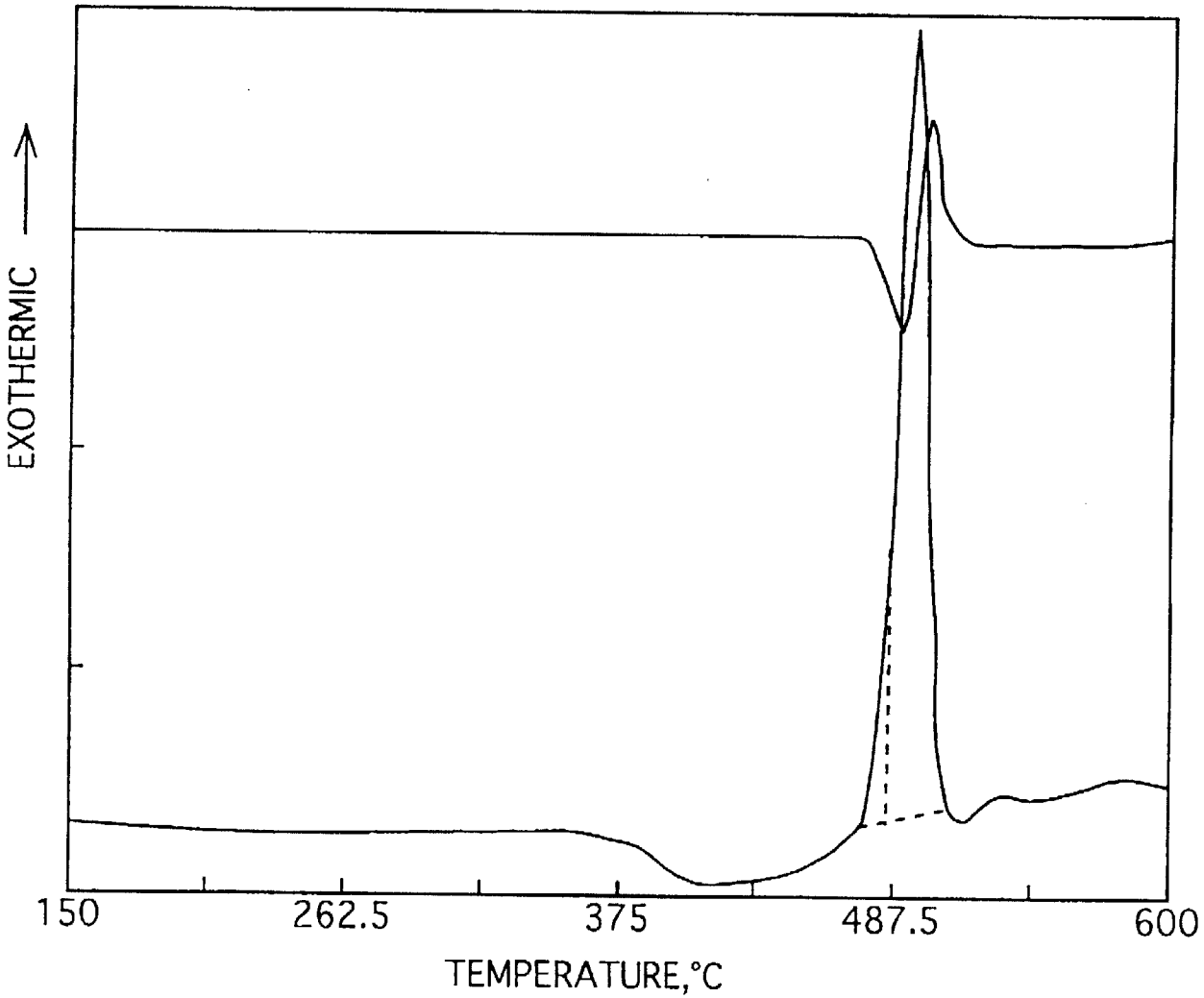
FIG. 6 This figure shows differential scanning calorimetry curve and its differential curve for the bulky amorphous Zr-Al-Ni-Cu alloy ingots produced in the Example of the invention. The curves shown represent those for the specimens taken from longitudinally and transversely central region of the ingots.

The results are shown in FIGS. 5 and 6.

FIG. 5 represents X-ray diffraction patterns of two $Zr_{65}Al_{7.5}Ni_{10}Cu_{17.5}$ alloy ingots of different sizes for the specimens each taken from the central region of the transverse sections at axially intermediate portion of the ingot. The bulk alloy ingots were cylindrical rods each having a diameter of 10 mm and 16 mm. The X-ray diffraction patterns of both ingots only had a broad halo peak to indicate the predominance of the amorphous phase. The optical micrographs of the transverse cross sections of the bulk alloy ingots included no contrast indicative of the crystal phase for the section taken from the substantially central portion of the bulk alloy ingot except for the small region of about 80 μm corresponding to the crystal phase, and this confirmed the results of the X-ray diffractometry.

In contrast, the specimens each taken from the region of the bulk alloy ingots in the vicinity of the end near the copper hearth (copper furnace bed) exhibited the copresence of the amorphous phase and crystalline phase. X-ray diffractometry of the crystalline phase revealed that the crystalline phase presumably comprises the phase of $Zr_2$(Cu, Ni, Pd) compound including Ni and Pd at Cu sites since the phase could be diffracted primarily as $Zr_2Cu$ of bct structure. As described above, the phase of this compound was found to be formed in the region in contact with the copper furnace bed that had been quenched at a high rate, and therefore, it was deduced that such crystalline phase was formed through heterogeneous nucleation upon contact with the copper furnace bed.

In the region in direct contact with the water-cooled copper furnace bed, the alloy melt is at a temperature near its melting point, and it is difficult to heat the alloy melt of this region to a temperature significantly higher than the melting point as in the case of the region remote from the copper furnace bed. The cooling (quenching) rate in the central portion of the 10 mm diameter bulk alloy ingot in the case of the suction casting was estimated by evaluating Al-33% by mass Cu alloy ingot of the same volume for the secondary dendrite arm spacing, and the cooling rate was estimated to be about $1\times10^2$ K/s. Such cooling rate is significantly higher than the critical cooling rate for the amorphous phase formation of about 10 K/s, and this is consistent with the fact of the formation of the amorphous phase in the substantially central portion of the bulk alloy ingot where influence of the heterogeneous nucleation is absent.

FIG. 6 represents DSC curve and its differential curve of the amorphous phase taken from the substantially central portion of the bulk alloy ingot prepared by the suction casting of this Example. The initiation of endothermic reaction by glass transition and the initiation of the exothermic reaction by crystallization are found at 359° C. and 473° C., respectively, and the supercooled liquid state is found over a considerably wide temperature range of 114° C. The results as described above demonstrate the capability of the suction casting process to produce a really glassy metal, and in addition, capability of the suction casting process to produce a large-sized bulk alloy ingot solely comprising the amorphous phase by suppressing the occurrence of the heterogeneous nucleation. The Vickers hardness (Hv) of the large-sized amorphous bulk alloy ingots produced in the Example was measured to be 530, which is a value equivalent with the value (550) measured for the corresponding sampling in the form of a ribbon.

As set forth above in detail, a bulk glassy metal of a large size with different cross sections can be conveniently produced in a simple process by utilizing the suction casting of the present invention. The amorphous phase generating technique of the suction casting according to the present invention capable of producing a bulk alloy of various configurations and sizes is quite important for the field of amorphous alloy that is in transition from basic research to the production of industrial material, and the significance of the suction casting according to the present invention resides primarily in that it has pioneered the production of a large-sized bulk amorphous alloy of any desired size and configuration.

We claim:

1. A method for producing a glassy metal by suction casting comprising the steps of:

filling a metal material in a mold cooled with water;

melting said metal material by using a high-energy heat source which is capable of melting said metal material;

and introducing the resulting molten metal instantaneously into a vertically extending water-cooled mold provided below said mold by using a pressure difference caused by lowering a vertically slidable piston within said vertically extending mold on which the metal melt rests to draw the metal melt into said vertically extended mold at a speed of at least 50 mm/sec and attain a high quenching rate to thereby enable the production of a glassy metal ingot of a large size.

2. A method for producing a glassy metal by suction casting according to claim 1 wherein said glassy metal formed in the vertically extending water-cooled casting mold is in the form of one of a cylindrical rod, a plate, a pipe, a rectangular rod, a rectangular pipe, a profile rod, and a profile pipe.

* * * * *